US005092265A

United States Patent [19]

Hughes et al.

[11] Patent Number: 5,092,265

[45] Date of Patent: Mar. 3, 1992

[54] APPARATUS FOR APPLYING RESIN COATINGS

[76] Inventors: J. David Hughes, 942 Hot Springs Rd., Montecito, Calif. 93108; William V. Haberer, 451 Canon Green, #B, Goleta, Calif. 93117; Michael J. Gilligan, Sr., 1075 Linden Ave., Carpinteria, Calif. 93013

[21] Appl. No.: 425,563

[22] Filed: Oct. 23, 1989

[51] Int. Cl.[5] ..... B05C 7/02

[52] U.S. Cl. ..... 118/317; 118/323; 427/236

[58] Field of Search ..... 118/306, 317, 323; 239/223; 427/236

[56] References Cited

U.S. PATENT DOCUMENTS

| | | | |
|---|---|---|---|
| 3,029,027 | 4/1962 | Gray | 118/306 |
| 3,044,441 | 7/1962 | Blakeslee et al. | 118/317 |
| 3,159,895 | 12/1964 | Perovich | 118/306 |
| 3,459,586 | 8/1969 | Kiwiet et al. | 118/323 |
| 4,106,964 | 8/1978 | De Vittorio | 118/306 |
| 4,377,127 | 3/1983 | Tinchon | 118/306 |
| 4,741,795 | 5/1988 | Grace et al. | 118/306 |

FOREIGN PATENT DOCUMENTS

| | | | |
|---|---|---|---|
| 114604 | 8/1942 | Sweden | 239/223 |

*Primary Examiner*—Willard E. Hoag

*Attorney, Agent, or Firm*—Fliesler, Dubb, Meyer & Lovejoy

[57] ABSTRACT

Apparatus for applying a two component coating material to a surface defining a cavity. The apparatus includes injection means for injecting coating material into the cavity and means for generating a turbulent region into which region the coating material is injected and for dispersing the coating material radially outward toward the surface. The present invention also employs a novel method for applying a coating to the surface of a symmetrical cavity comprising the steps of advancing a coating apparatus mounted at the end of an elongated support member into the cavity to be coated and applying the coating to the interior surface of the cavity.

2 Claims, 3 Drawing Sheets

APPARATUS FOR APPLYING RESIN COATINGS

BACKGROUND OF THE INVENTION

The present invention relates to the application of coatings and, more specifically, to an apparatus and method for spray coating the interior surfaces of manholes, wetwells and, generally, the surfaces of structures which are often symmetrical.

In recent years, the general public has become greatly concerned over the ecological condition of the environment. This concern has, in large part, been focused on water pollution and the contamination of the potable water supply by such detrimental agents as raw sewage, chemical waste and the like. For example, procedures for the transportation and disposal of raw sewage and other environmental pollutants have become significantly more rigorous due to environmental legislation and regulations.

Likewise, the condition of drinking water has been of concern. Seepage of toxins, emanating from the ground and from other sources of toxic waste, can contaminate potable water supplies.

Conduit seepage often provides the greatest challenge to rendering the transport of both waste and potable water environmentally sound. Conduits used to transport sewage and potable water are often fabricated of semi-porous materials such as concrete, cement aggregate or terra cotta. Environmentally damaging waste will often seep out of porous conduits into the surrounding soil so as to contaminate surrounding groundwater resources. Conversely, toxins can seep into potable water conduits contaminating water flowing through the conduit.

Coatings applied to the interior surfaces of these conduits can greatly aid in the reduction of seepage. These coatings, which must themselves be environmentally safe, are very often applied to the interiors of the conduits by spraying the coating liberally about the interior surface in order to effectively seal the interior of the conduit.

In large cities, sewer and potable water systems often consist of vast mazes of interconnected subterranean conduits accessed at intervals by manholes or wetwells which lead down to the conduit interiors. Because seepage may also occur through the interior surfaces of manholes and wetwells, the manhole surfaces must also be coated with a coating substance designed to seal the manhole and minimize seepage of toxic substances into the surrounding environment.

The effective application of coatings to the vertical surfaces of manholes, wetwells or other vertical shafts or conduits has proven to be particularly difficult. Typically, a spray gun operator is lowered by rope or cable into the manhole to be coated. Most conventional spray coating application systems require that a human operator be physically adjacent to the area to be coated. Suspended by rope, the spray gun operator applies the coating to the surface of the manhole using a spray gun or nozzle apparatus.

This system is extremely undesirable due both to the dangers inherent to the person applying the coating and to the often haphazard results achieved by the applying the coating in this manner. Obviously, because the spray gun operator is dangling at the end of a rope, a substantial risk of injury exists. Moreover, the presence of the spray gun operator in an enclosed area containing a substantial amount of airborne atomized spray coating, which can be hazardous when inhaled over prolonged periods, poses another very significant health risk to the spray gun operator. In the same vein, manholes and wetwell shafts may often contain toxic gases and contaminants which, after prolonged exposure, can adversely effect the health of the spray gun operator.

Additionally, as the spray gun operator is raised up the manhole, his dangling legs, feet, arms or equipment may strike the surface which has just been coated, thereby undermining the integrity of the newly applied coating and causing a thinly coated or uncoated area where seepage will likely occur. Thus, the presence of a spray gun operator in the manhole or other vertical shaft for the purpose of applying coatings is extremely undesirable.

The material used to coat vertical surfaces, such as manholes and other vertical shafts, typically consists of a polymer formed in situ from two components: a liquid resin base and a curing catalyst. The liquid resin base is designed to cure and harden into a solid resin shortly after the curing catalyst is added to it so that it will not run down the vertical surface being coated. The resin base and curing catalyst should ideally be mixed immediately prior to applying it to the surface to be coated.

Consequently, a number of spray apparatus have been designed to apply the curing coating immediately after the resin base and the curing catalyst have been mixed. The most popular coating application apparatus, as noted, is the spray gun. These spray guns might typically include two atomizer nozzles: one for atomizing the liquid resin base and the other for atomizing the curing catalyst. The two nozzles are disposed such that the dispersion paths of the liquid resin base and the curing catalyst cross and, ideally, the two components intermix prior to application to the surface to be coated. Another type of spray gun system has only one nozzle having an antechamber where the two components are mixed.

However, spray guns are not particularly well adapted for use in vertical environments. As noted, the spray gun operator must be located adjacent to the surface to be coated. Consequently, the spray gun operator must be lowered into the manhole. Because manholes and wetwells are frequently lined with a cement and gravel aggregate mixture, the spray gun operator must take great care to apply the coating liberally at various angles of spray incidence. If the spray gun operator fails to apply the coating from various angles of incidence, discontinuities and rough and uneven areas along the surface may not be completely coated.

Hence, a need exists in the art for a method and apparatus for thoroughly applying multicomponent coatings to the enclosed vertical surfaces of manholes or access conduits without the necessity of lowering a spray gun operator into the manhole or conduit.

SUMMARY OF THE INVENTION

The present invention is directed to a novel method and apparatus for applying a coating material to a surface defining a cavity. The apparatus includes injection means for injecting coating material into the cavity and means for generating a turbulent region into which region the coating material is injected and for dispersing the coating material radially outward toward the surface. The present invention also employs a novel method for applying a coating to the surface of a cavity comprising the steps of advancing a coating apparatus mounted at the end of an elongated support member into the cavity to be coated and applying the coating to the interior surface of the cavity.

In accordance with one embodiment, the present invention employs a pneumatically driven turbine impeller that both mixes two components of the coating material, the resin base and the curing catalyst, and distributes the coating material in a uniform manner upon the surface to be coated. The primary method of mixing is achieved by the turbulent action produced by the vanes of the impeller. Additionally, these vanes are the source of directional distribution of the coating material to the vertical surface.

Because many of the surfaces to be coated have irregularities such as protruding aggregate, the design can incorporate a feature whereby the direction of rotation of the turbine impeller can be reversed thereby assuring complete coverage even on an irregular surface.

It is an object of the present invention to provide means by which the surfaces of structures such as manholes and wetwells, especially those with limited access or the possible presence of toxic gases or air deficiency, can be coated without requiring the physical entry of a spray gun operation into the structure.

It is a further object of the present invention to provide means by which two components can be mixed just prior to application to the surfaces and to provide uniform distribution of a coating produced by the components on irregular surfaces.

It is yet another object of the present invention to achieve this mixing and uniform distribution through the use of a single, pneumatically driven impeller.

DETAILED DESCRIPTION OF THE DRAWING

Figure 1:
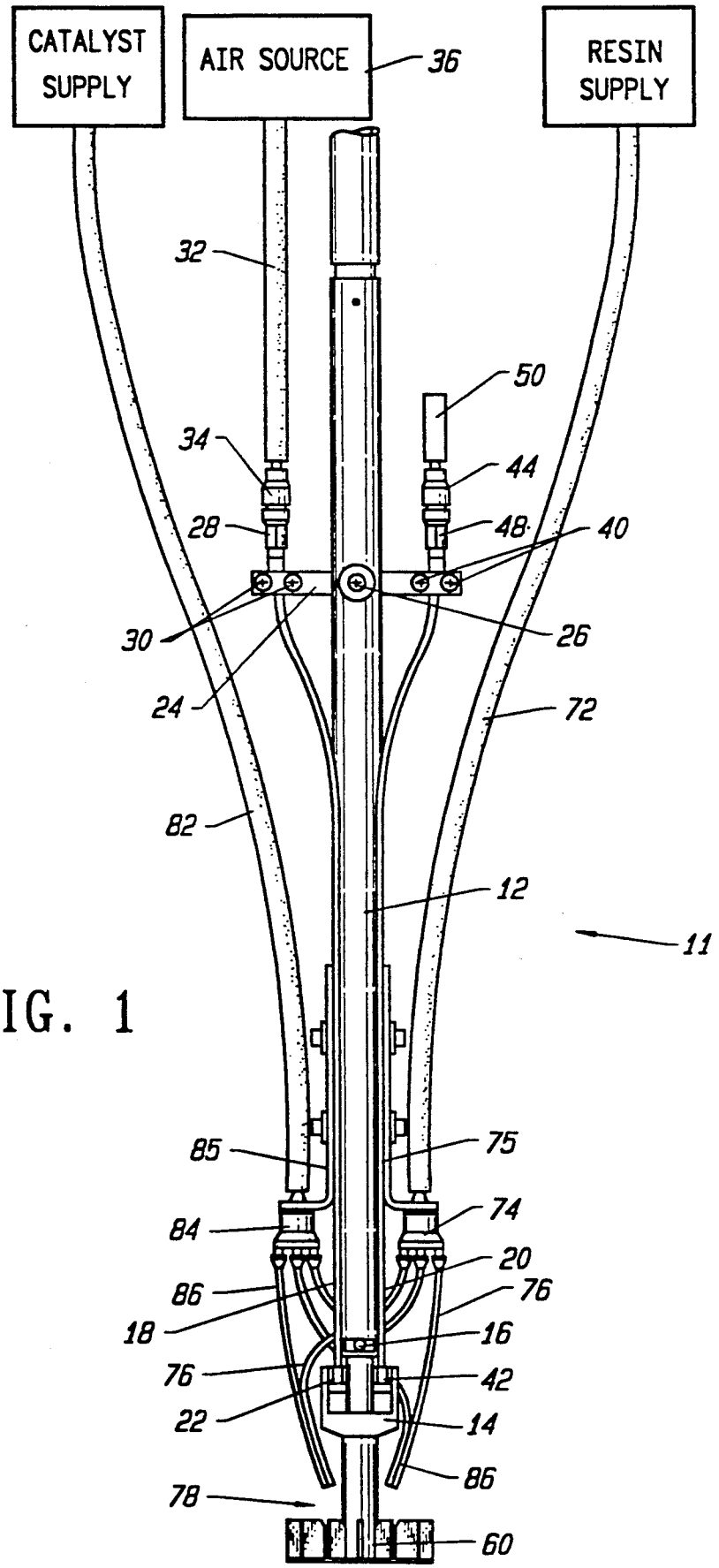
FIG. 1 is an elevational side view of the preferred embodiment of the applicator assembly of the subject invention.

FIG. 1 is an elevational side view of the preferred embodiment of the applicator assembly of the subject invention. The applicator assembly of the present invention is designated generally as 11. Assembly 11 has a main supporting member 12, which is tubular in configuration and may be constructed of any type of rigid lightweight material such as fiberglass or aluminum. A high speed pneumatic motor 14 is attached to the end of the supporting member 12 by a hose clamp 16. Any conventional bidirectional high speed pneumatic motor may be used. In the preferred embodiment of the present invention, a pneumatic motor having an operating speed of 6000 revolutions per minute is used.

Figure 2:
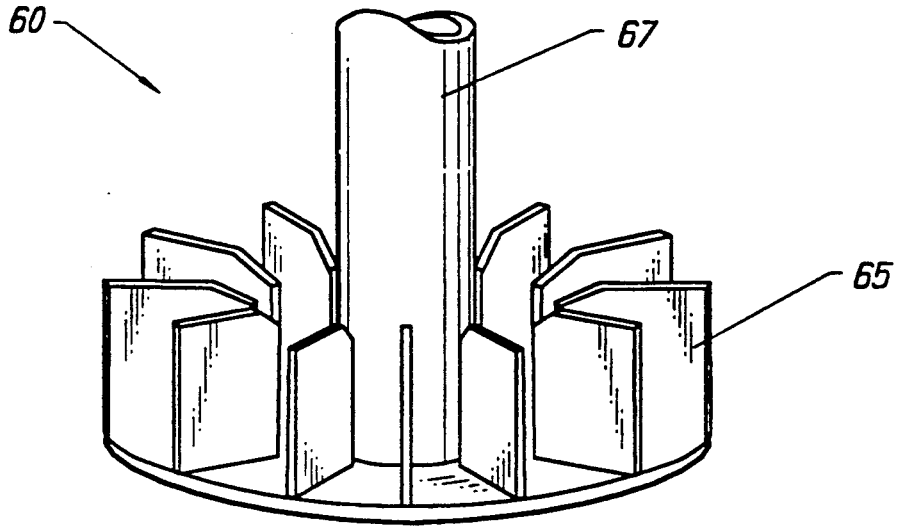
FIG. 2 is a perspective view of the turbine impeller of the preferred embodiment of the present invention.

A turbine impeller 60 is attached to the rotor, not shown, of high speed pneumatic motor 14. The turbine impeller 60 is shown in greater detail in FIG. 2. The turbine impeller 60 has a plurality of vanes 65 disposed about its circumference. The vanes 65 are tapered downward and towards impeller shaft 67. Although any number of vanes designs may be used, the vanes are preferably designed to enable the turbine impeller 60 to generate a region of turbulence regardless of the direction of rotation of the turbine. The rapid rotation of turbine impeller 60 results in the generation of a region of turbulence at 78, shown in FIG. 3.

Referring again to FIG. 1, the high speed pneumatic motor 14 is activated by air which is supplied to it through an air line 18 secured to the high speed pneumatic motor 14 by nut 22. Air hose coupler mounting bracket 24 is bolted to supporting member 12 by bracket bolt 26. Snap coupler 28 is mounted on air hose coupler mounting bracket 24 by mounting bolts 30. Any conventional pneumatic line coupler may be used, although a coupler which enables easy attachment and detachment is preferable. Air line 18 extends from nut 22 to snap coupler 28. Air line 18 is attached to snap coupler 28. Source air line 32 extends from a source 36 of pressurized air and has a snap coupler 34 attached at one end which is adapted to mate with snap coupler 28. Snap coupler 34 is snapped into sealed engagement with snap coupler 28.

Air line 20 is used as a pneumatic motor exhaust line. Air exiting the pneumatic motor 14 is channeled out through air line 20. The configuration of air line 20 is identical to that of air line 18. Air line 20 is secured to the high speed pneumatic motor 14 by nut 42. Snap coupler 48 is mounted on air hose coupler mounting bracket 24 by mounting bolts 40. Likewise, any conventional pneumatic line coupler may be used, although a coupler which enables easy attachment and detachment is preferable. Moreover, snap coupler 48 should be compatible for attachment to snap coupler 34. Air line 20 extends from nut 42 to snap coupler 48. Air line 20 is attached to snap coupler 48. Pneumatic motor exhaust muffler 50, having a snap coupler 44 capable of being coupled in sealed engagement with snap coupler 48, is snapped into sealed engagement with snap coupler 48. Air motor exhaust muffler 50 is a conventional pneumatic motor muffler.

The air supply and exhaust connections are interchangeable so as to enable a quick reverse in the rotation direction of the impeller 60. To reverse the rotation direction of the impeller 60, the air source line 32 is decoupled from snap coupler 28, not shown in FIG. 1. The pneumatic motor muffler 50 is detached from snap coupler 48. Air source line 32 is snapped into sealed engagement with snap coupler 48, not shown in FIG. 1. The pneumatic motor muffler 50 is snapped into sealed engagement with snap coupler 28, not shown in FIG. 1.

This bidirectional rotation is an extremely desirable feature of the preferred embodiment of the present invention. By alternating the direction of rotation of turbine impeller 60, rough surfaces, such as cement aggregate, are much more likely to be thoroughly coated. It has been found that surfaces coated using this bidirectional rotation feature are most often amply coated and the amount of surface area lacking sufficient coating is greatly reduced.

The liquid resin base is pumped by an independent pump, not shown in FIG. 1, through resin base line 72 to a resin base distribution manifold 74. Resin base distribution manifold 74 is mounted to supporting member 12 by support bracket 75, which is bolted to supporting member 12. The resin base distribution manifold 74 splits and conveys the resin base in approximately equal portions through three resin base tubes 76. The number of resin base tubes may vary depending upon the character and amount of resin base to be dispensed. The three resin base tubes 76 inject the resin base into a region 78 proximate to impeller 60. The chemical nature of the resin base is determined by the use desired and is unimportant to the invention. Typical resin bases include, however, polyesters and other resin bases.

The hardener or curing catalyst material is pumped by an independent pump, not shown in FIG. 1, through catalyst line 82 to a catalyst distribution manifold 84. It is selected to cross-link or polymerize the particular resin base as is well known in the chemical arts. Catalyst distribution manifold 84 is mounted to supporting member 12 by support bracket 85, which is bolted to supporting member 12. The catalyst distribution manifold splits and conveys the catalyst in approximately equal portions through three catalyst tubes 86. Each of the three catalyst tubes 86 is paired with a corresponding resin base tube 76. The three catalyst tubes 86 inject the curing catalyst material into the region 78 proximate to impeller 60.

Figure 3:
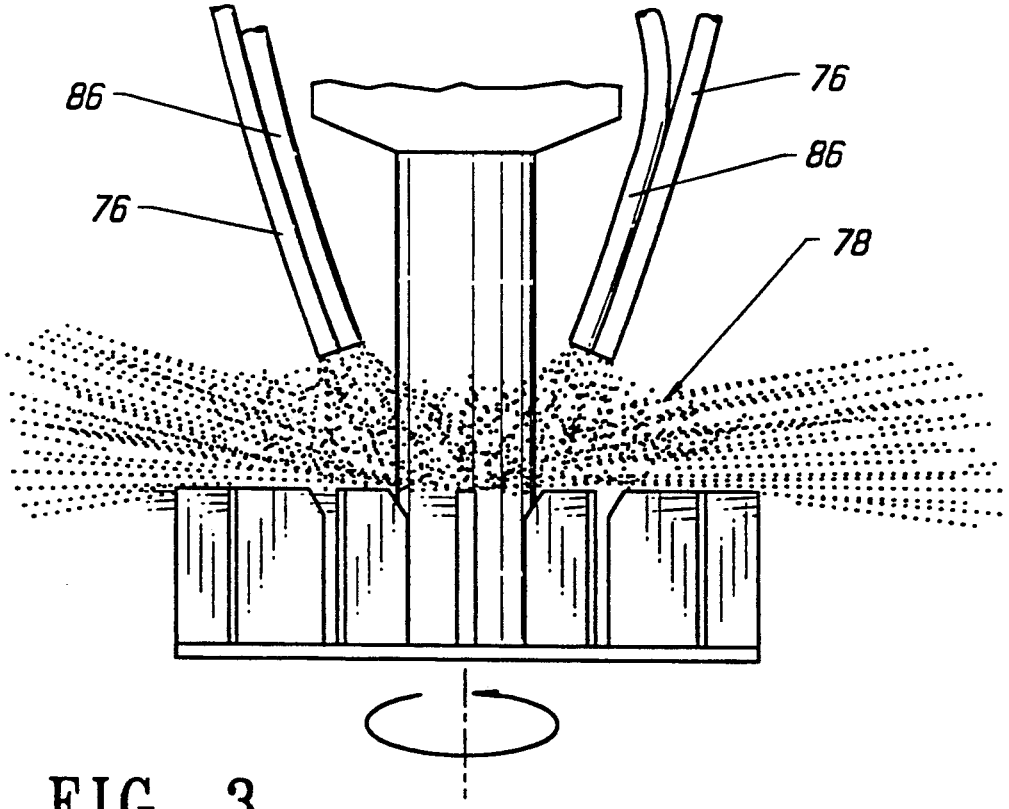
FIG. 3 is an isolated view of the turbine impeller of the preferred embodiment of the present invention mixing the catalyst and resin and the dispersing the mixture outward.

FIG. 3 is an isolated view of the turbine impeller 60 mixing the catalyst and resin base and dispersing the mixture outward. The turbulent air produced by impeller 60 at region 78 causes mixing of the resin base and curing catalyst material to occur. Because of the turbulent condition created by the rotation of turbine impeller at region 78, the resin base and catalyst materials, respectively injected into region 78 by resin base tubes 76 and curing catalyst tubes 86, are each essentially atomized and intermixed within region 78. The turbulence at region 78 imparts sufficient energy and momentum upon the mixed material to thrust the mixture at a high velocity radially outward toward and onto the walls of the surface to be coated.

Figure 4:
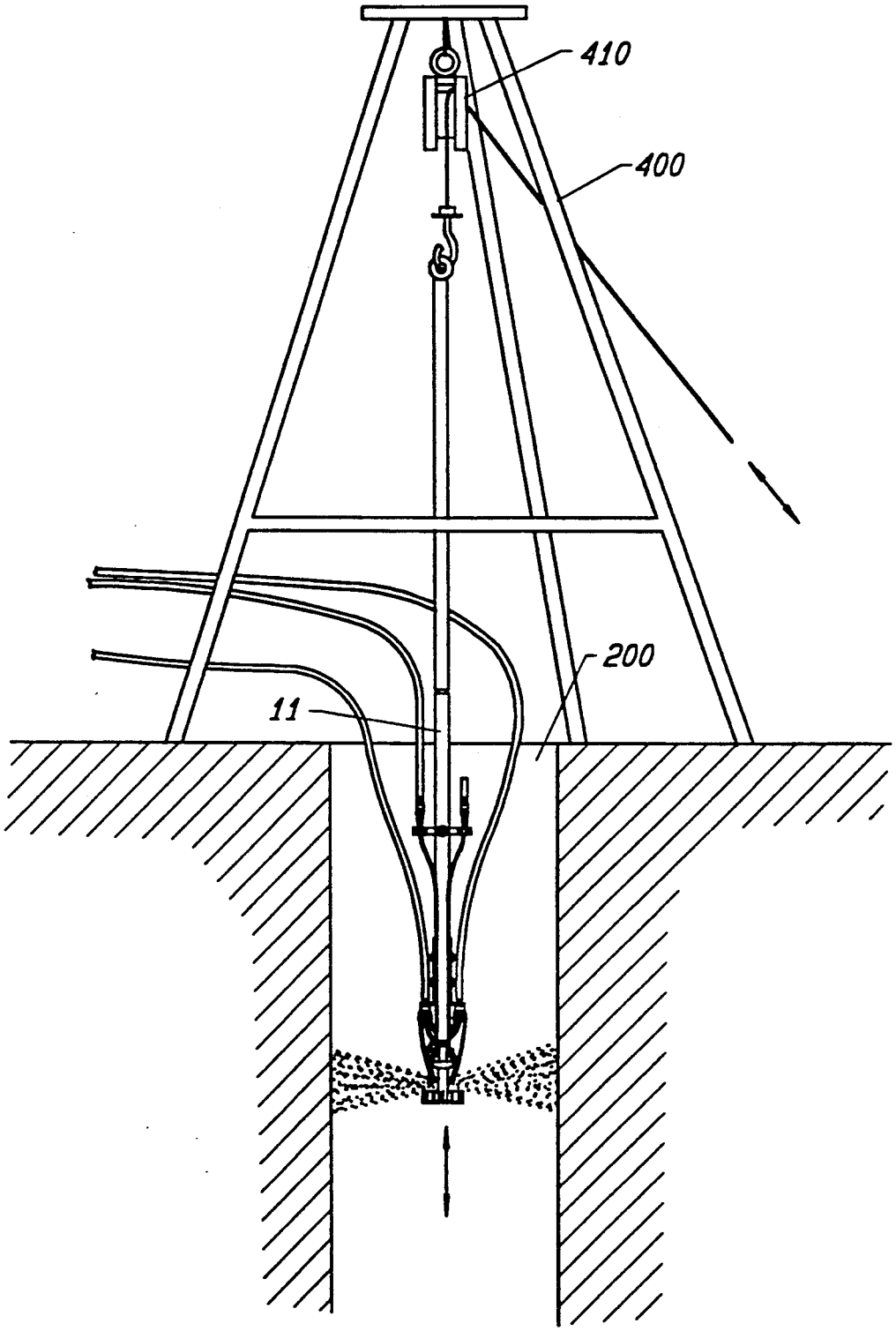
FIG. 4 is a view of the preferred embodiment of the applicator apparatus applying a coating to a manhole.

FIG. 4 is a view of the apparatus 11 applying a coating to a manhole 200. The apparatus 11 is lowered down into the manhole 200. Where the manhole depth is less than 25 feet, the apparatus 11 may be lowered into the manhole manually, not shown in FIG. 4. Where the depth of the manhole is greater than 25 feet, an A-frame tripod 400 and pulley 410, as shown in FIG. 4, or a similar machine, may be used to lower and raise the apparatus 11 in the manhole. The high speed pneumatic motor 14 is energized and turbine impeller 60 is rotated at high velocity as described above. The resin base and curing catalyst materials are injected into the turbulent region 78, mixed and dispersed outward toward and onto the surface of manhole 200. The apparatus is lowered and raised within the manhole in order to fully coat the entire length, not shown in FIG. 4, of the manhole 200.

To insure a complete and thorough coating, the direction of rotation of the turbine impeller 60 is then reversed, in the manner described above, and the coating process is repeated to insure that the entire surface has been liberally coated.

It will be understood that the above-described embodiment is merely illustrative of any possible specific embodiments and methods which can represent the principles of the present invention. Numerous and various other arrangements can readily be devised in accordance with these principles without departing from the spirit and scope of the invention. Thus, the foregoing specification is not intended to limit the invention which is defined in the appended claims.

What is claimed is:

1. An apparatus for applying coating material to a surface defining an essentially symmetrical cavity comprising:

a first means for injecting a resin coating component having a first plurality of outlets;

a second means for injecting a catalyst coating component having a plurality of outlets each one of said plurality of outlets of said second means being associated with one of said first plurality of outlets;

a rotatable shaft;

a turbine comprising a disc coupled to said shaft, a plurality of radially disposed blades, each of said blades being mounted for rotation on said disc such that said plurality of outlets is spaced from said blade; and means for rotating said rotatable shaft;

wherein said first and second means inject the resin coating component and the catalyst coating component into the region of turbulent air a spaced distance from said blades, such that the first coating component and the second coating component are mixed together and said mixture is dispersed radially outward toward the surface to be coated.

2. An apparatus for applying a coating material to a surface defining a cavity comprising:

injection means for injecting coating material into the cavity, said injection means including means for providing a first coating component and means for providing a second coating component, said first and second means being coupled to plurality of output ducts;

a rotatable shaft;

means for rotating said shaft, including means for selectively reversing the direction of rotation of said means for rotating; and a turbine comprising a disc attached to said shaft and having a plurality of radially disposed blades each having an end, each of said blades being attached by its end to said disc, wherein said output ducts for said coating components are spaced from said blades.

* * * * *